US012428732B2

(12) United States Patent
Kureishi et al.

(10) Patent No.: US 12,428,732 B2
(45) Date of Patent: Sep. 30, 2025

(54) METAL MATERIAL AND METHOD FOR MANUFACTURING METAL MATERIAL

(71) Applicant: Sumitomo Electric Industries, Ltd., Osaka (JP)

(72) Inventors: Yusuke Kureishi, Osaka (JP); Tomoharu Takeyama, Osaka (JP); Akihisa Hosoe, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 590 days.

(21) Appl. No.: 17/798,596

(22) PCT Filed: Feb. 25, 2020

(86) PCT No.: PCT/JP2020/007449
§ 371 (c)(1),
(2) Date: Aug. 10, 2022

(87) PCT Pub. No.: WO2021/171359
PCT Pub. Date: Sep. 2, 2021

(65) Prior Publication Data

US 2023/0090510 A1 Mar. 23, 2023

(51) Int. Cl.

| | |
|---|---|
| ***C23C 18/32*** | (2006.01) |
| ***C23C 18/16*** | (2006.01) |
| ***C23C 18/18*** | (2006.01) |

(52) U.S. Cl.
CPC ..... *C23C 18/32* (2013.01); *C23C 18/1644* (2013.01); *C23C 18/1817* (2013.01); *C23C 18/1827* (2013.01)

(58) Field of Classification Search
USPC ..... 148/276
See application file for complete search history.

(56) References Cited

U.S. PATENT DOCUMENTS

2009/0027832 A1* 1/2009 Aoyama ..... H01G 9/04 361/523
2021/0130968 A1 5/2021 Yamauchi et al.

FOREIGN PATENT DOCUMENTS

JP 2001209925 A * 8/2001 ..... C23C 28/321
JP 2009049376 A * 3/2009 ..... H01G 9/04
JP 2019-206740 A 12/2019
WO WO-2018/124116 A1 7/2018

* cited by examiner

*Primary Examiner* — Ricardo D Morales
(74) *Attorney, Agent, or Firm* — Faegre Drinker Biddle & Reath LLP

(57) ABSTRACT

A metal material comprising: a base material; an oxide layer disposed on a surface of the base material; and a metal layer disposed on a surface of the oxide layer, wherein the base material includes aluminum, the oxide layer includes aluminum, nickel, and oxygen, the metal layer includes nickel, and an average thickness of the oxide layer is no less than 50 nm and no more than 250 nm.

15 Claims, 3 Drawing Sheets

METAL MATERIAL AND METHOD FOR MANUFACTURING METAL MATERIAL

TECHNICAL FIELD

The present disclosure relates to a metal material and a method for manufacturing the metal material.

BACKGROUND ART

Patent Literature 1 discloses a surface-treated material comprising an electroconductive substrate, a surface treatment coating film formed on the electroconductive substrate, and an intervening layer disposed between the electroconductive substrate and the surface treatment coating film. The electroconductive substrate is made of aluminum or an aluminum alloy. The surface treatment coating film is made of nickel or the like. The intervening layer contains a metal component in the electroconductive substrate, a metal component in the surface treatment coating film, and an oxygen component. The average thickness of the intervening layer is no less than 1 nm and no more than 40 nm as measured on the vertical cross section of the surface-treated material.

CITATION LIST

Patent Literature

PTL 1: WO 2018/124116

SUMMARY OF INVENTION

The metal material of the present disclosure comprises:
- a base material;
- an oxide layer disposed on a surface of the base material; and
- a metal layer disposed on a surface of the oxide layer, wherein
- the base material includes aluminum,
- the oxide layer includes aluminum, nickel, and oxygen,
- the metal layer includes nickel, and
- an average thickness of the oxide layer is no less than 50 nm and no more than 250 nm.

The method for manufacturing a metal material according to the present disclosure comprises:
- providing a base material including aluminum;
- disposing a precursor layer including aluminum and nickel on a surface of the base material;
- disposing a metal layer including nickel on a surface of the precursor layer; and
- applying heat treatment to the base material on which the precursor layer and the metal layer are disposed, at a temperature of no less than 400° C. and no more than 600° C. to transform the precursor layer into an oxide layer including aluminum, nickel, and oxygen, wherein the disposing a precursor layer comprises:
- forming a thin film including aluminum oxide on the surface of the base material; and
- applying electroless plating to the base material on which the thin film is formed, using a nickel plating solution having a pH of more than 9 and less than 11 at 25° C.

DETAILED DESCRIPTION

Figure 1:
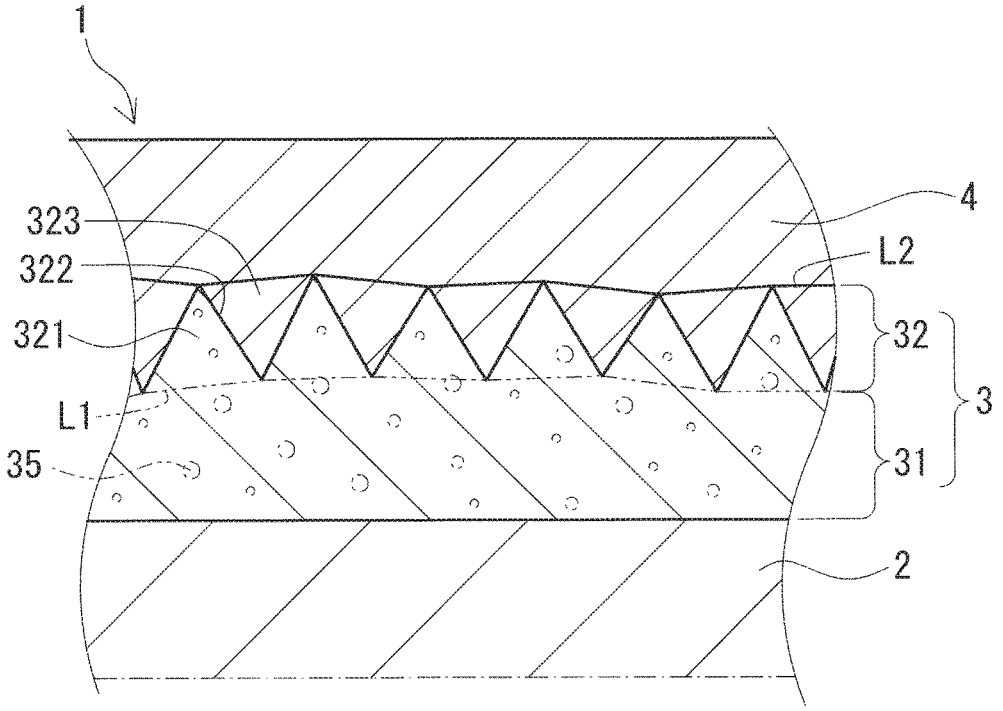
FIG. 1 is a cross-sectional view schematically showing a part of the metal material of an embodiment.

Problem to be Solved by the Present Disclosure

Further improvement in heat resistance is desired for a metal material in which the surface of the base material including aluminum is coated with the metal layer including nickel. In the technique disclosed in Patent Literature 1, even if the close adhesion between the base material and the metal layer is secured by the intervening layer, the metal layer may be peeled off in a high temperature environment of, for example, no less than 300° C.

Accordingly, an object of the present disclosure is to provide a metal material excellent in heat resistance. In addition, another object of the present disclosure is to provide a method for manufacturing a metal material, which can provide a metal material excellent in heat resistance.

Advantageous Effect of the Present Disclosure

The metal material of the present disclosure is excellent in heat resistance. The method for manufacturing a metal material according to the present disclosure can provide a metal material excellent in heat resistance.

DESCRIPTION OF EMBODIMENTS

First, embodiments of the present disclosure will be listed and described.

(1) The metal material according to an aspect of the present disclosure comprises:
- a base material;
- an oxide layer disposed on a surface of the base material; and
- a metal layer disposed on a surface of the oxide layer, wherein
- the base material includes aluminum,
- the oxide layer includes aluminum, nickel, and oxygen,
- the metal layer includes nickel, and
- an average thickness of the oxide layer is no less than 50 nm and no more than 250 nm.

Because the oxide layer is no less than 50 nm, mutual diffusion of aluminum included in the base material and nickel included in the metal layer can be suppressed even in a high temperature environment of no less than 300° C. Because the mutual diffusion of aluminum and nickel can be suppressed, the formation of a Kirkendall void in a surface layer region of the base material can be suppressed. Because the formation of a Kirkendall void can be suppressed, the metal material of the present disclosure is excellent in heat resistance. The heat resistance as used here refers to how difficult it is for peeling of the metal layer to occur when heat is applied to the metal material. On the other hand, because the oxide layer is no more than 250 nm, reduction in the bending workability of the metal material can be suppressed. The bending workability as used here refers to how difficult it is for peeling of the metal layer to occur when bending work is applied to the metal material.

(2) In one example of the metal material of the present disclosure, the oxide layer may comprise:

a base layer disposed on a base material side; and a composite layer disposed on a metal layer side, wherein the base layer may have a higher content of aluminum than that of nickel and the composite layer may have a higher content of nickel than that of aluminum.

Because the oxide layer has a two-layer structure consisting of a base layer and a composite layer, the close adhesion between the base material and the metal layer is easily improved.

(3) In one example of the metal material of the present disclosure in which the oxide layer comprises a base layer and a composite layer, the base layer may include no less than 30 atomic % and no more than 60 atomic % of aluminum.

Because the content of aluminum included in the base layer satisfies the above range, the close adhesion between the base material and the oxide layer is easily improved, and accordingly the close adhesion between the base material and the metal layer is easily improved.

(4) In one example of the metal material of the present disclosure in which the oxide layer comprises a base layer and a composite layer, the composite layer may include no less than 30 atomic % and no more than 70 atomic % of nickel.

Because the content of nickel included in the composite layer satisfies the above range, the close adhesion between the oxide layer and the metal layer is easily improved, and accordingly the close adhesion between the base material and the metal layer is easily improved.

(5) In one example of the metal material of the present disclosure in which the oxide layer comprises a base layer and a composite layer, the average thickness of the base layer may be no less than 30 nm and no more than 230 nm.

Because the average thickness of the base layer is no less than 30 nm, the close adhesion between the base material and the oxide layer is easily improved, and accordingly the close adhesion between the base material and the metal layer is easily improved. On the other hand, because the average thickness of the base layer is no more than 230 nm, the thickness of the composite layer can be relatively secured to some extent.

(6) In one example of the metal material of the present disclosure in which the oxide layer comprises a base layer and a composite layer, the average thickness of the composite layer may be no less than 20 nm and no more than 220 nm.

Because the average thickness of the composite layer is no less than 20 nm, the close adhesion between the oxide layer and the metal layer is easily improved, and accordingly the close adhesion between the base material and the metal layer is easily improved. On the other hand, because the average thickness of the composite layer is no more than 220 nm, the thickness of the base layer can be relatively secured to some extent.

(7) In one example of the metal material of the present disclosure in which the oxide layer comprises a base layer and a composite layer, the composite layer may comprise:

a plurality of protrusions protruding from the base layer; and a metal portion interposed between adjacent protrusions thereof, wherein each of the plurality of protrusions may include aluminum and oxygen and the metal portion may include nickel.

Because the metal portion includes nickel, the close adhesion to the metal layer is high. Because the metal portion is interposed between the plurality of protrusions, the close adhesion between the metal portion and the protrusions is high due to the anchor effect, and accordingly the close adhesion between the composite layer and the metal layer is high. Therefore, because the composite layer is constituted by a composite of the protrusion and the metal portion, the close adhesion between the oxide layer and the metal layer is easily improved, and accordingly the close adhesion between the base material and the metal layer is easily improved.

(8) In one example of the metal material of the present disclosure, the interface at which the base material and the oxide layer is in contact with each other may be formed in an uneven shape.

Because the interface is formed in the uneven shape, the close adhesion between the base material and the oxide layer is easily improved by the anchor effect, and accordingly the close adhesion between the base material and the metal layer is easily improved.

(9) In one example of the metal material of the present disclosure, the oxide layer may include a plurality of dispersed pores.

Because a plurality of pores are dispersed in the oxide layer, the bending workability of the metal material is easily improved. It should be noted that these pores do not substantially affect the deterioration of heat resistance, unlike the Kirkendall void which can be formed in a surface layer region of the base material by the mutual diffusion of the metal elements constituting the metal material.

(10) In one example of the metal material of the present disclosure that has a plurality of pores in the oxide layer, the size of the pores may be no less than 1 nm and no more than 50 nm.

Because the size of the pores is no less than 1 nm, the bending workability of the metal material is easily improved. On the other hand, because the size of the pores is no more than 50 nm, brittle fracture is suppressed.

(11) In one example of the metal material of the present disclosure, the average thickness of the metal layer may be no less than 3 μm and no more than 15 μm.

Because the average thickness of the metal layer is no less than 3 μm, the heat resistance is easily improved. On the other hand, because the average thickness of the metal layer is no more than 15 μm, the bending workability of the metal material is easily improved.

(12) In one example of the metal material of the present disclosure, the base material may be a wire rod, wherein the diameter of the wire rod may be no less than 0.04 mm and no more than 5 mm.

As described above, the metal material of the present disclosure is not only excellent in heat resistance but also excellent in bending workability. Therefore, the metal material of the present disclosure can be suitably used for a wire rod that is often subjected to bend work before use. Because the diameter of the wire rod is no less than 0.04 mm, the strength of the base material is easily maintained, and a metal material excellent in bending resistance is easily obtained. On the other hand, because the diameter of the wire rod is no more than 5 mm, the bending workability of the metal material is easily improved.

(13) In one example of the metal material of the present disclosure, the base material may be a wire rod and the proportion of the average thickness of the oxide layer to the diameter of the base material may be no less than 0.00005 and no more than 0.0025.

Because the above proportion is no less than 0.00005, the thickness of the oxide layer is secured to some extent, and the heat resistance is easily improved. On the other hand, because the above proportion is no more than 0.0025, the thickness of the oxide layer is not too large, and the bending workability of the metal material is easily improved.

(14) In one example of the metal material of the present disclosure, the base material may be a wire rod and the proportion of the average thickness of the metal layer to the diameter of the base material may be no less than 0.003 and no more than 0.075.

Because the above proportion is no less than 0.003, the thickness of the metal layer is secured to some extent, and the heat resistance is easily improved. On the other hand, because the above proportion is no more than 0.075, the thickness of the metal layer is not too large, and the bending workability of the metal material is easily improved.

(15) In one example of the metal material of the present disclosure in which the oxide layer comprises a base layer and a composite layer, the base material may be made of an aluminum alloy including a doped element and the base layer may include the doped element.

Because the base material is made of an aluminum alloy, the strength of the base material can be improved, and accordingly the strength of the metal material can be improved. Because the metal element included in the base material is included in the base layer, the close adhesion between the base material and the oxide layer is easily improved, and accordingly the close adhesion between the base material and the metal layer is easily improved.

(16) In one example of the metal material of the present disclosure, the oxide layer may include no less than 20 atomic % and no more than 55 atomic % of oxygen.

Because the content of oxygen included in the oxide layer satisfies the above range, the close adhesion between the base material and the metal layer is easily improved.

(17) The method for manufacturing a metal material according to an aspect of the present disclosure comprises:

providing a base material including aluminum;

disposing a precursor layer including aluminum and nickel on a surface of the base material;

disposing a metal layer including nickel on a surface of the precursor layer; and applying heat treatment to the base material on which the precursor layer and the metal layer are disposed, at a temperature of no less than 400° C. and no more than 600° C. to transform the precursor layer into an oxide layer including aluminum, nickel, and oxygen, wherein the disposing a precursor layer comprises:

forming a thin film including aluminum oxide on the surface of the base material; and applying electroless plating to the base material on which the thin film is formed, using a nickel plating solution having a pH of more than 9 and less than 11 at 25° C.

In disposing a precursor layer, a precursor layer including a large amount of a metal hydroxide can be disposed on the surface of the base material by applying electroless plating using an alkaline nickel plating solution having a relatively high pH. By disposing a metal layer on the surface of the precursor layer and then applying heat treatment, an oxide layer in which the metal hydroxide included in the precursor layer is converted into a metal oxide can be formed. At this time, because the heat treatment temperature is no less than 400° C., the metal hydroxide is converted well into the metal oxide. In addition, because the heat treatment temperature is no less than 400° C., the average thickness of the oxide layer formed is easily set to no less than 50 nm. On the other hand, because the heat treatment temperature is no more than 600° C., the average thickness of the oxide layer formed is easily set to no more than 250 nm. Thus, according to the method for manufacturing a metal material described above, a metal material including a base material, an oxide layer disposed on the surface of the base material, and the metal layer disposed on the surface of the oxide layer can be obtained. In particular, by applying electroless plating using an alkaline nickel plating solution having a relatively high pH to dispose the precursor layer and then applying heat treatment at a specific temperature, an oxide layer which is relatively thick and has an average thickness of no less than 50 nm and no more than 250 nm is easily obtained.

Details of Embodiments of the Present Disclosure

Figure 3:
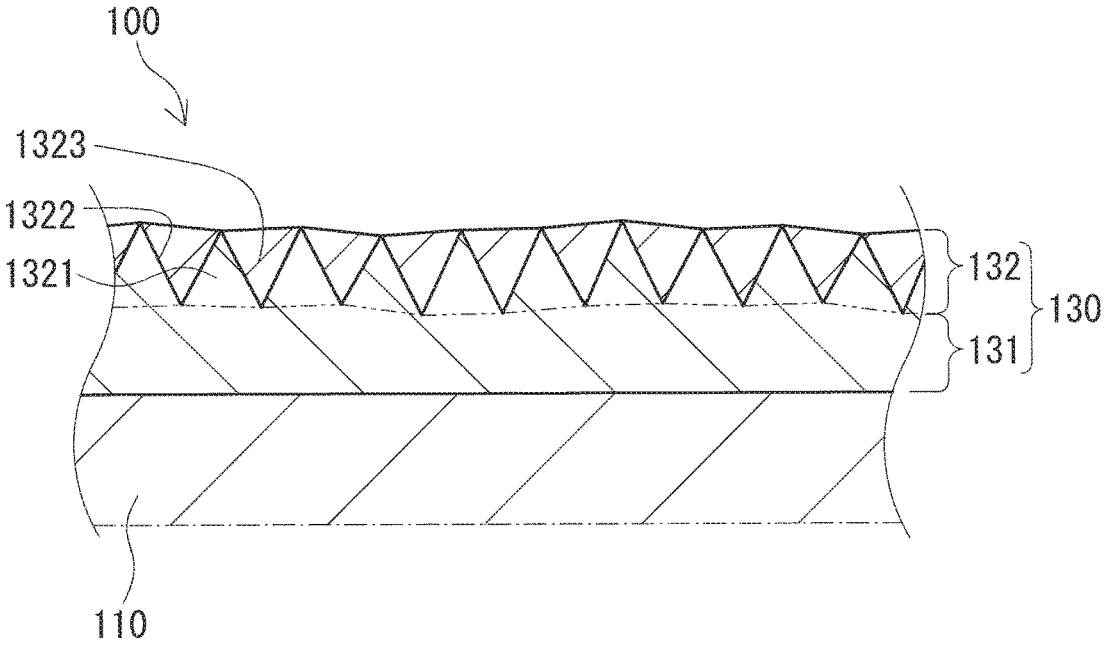
FIG. 3 is a cross-sectional view schematically showing a part of a first coating material obtained by disposing a precursor layer in the method for manufacturing a metal material according to an embodiment.
Figure 4:
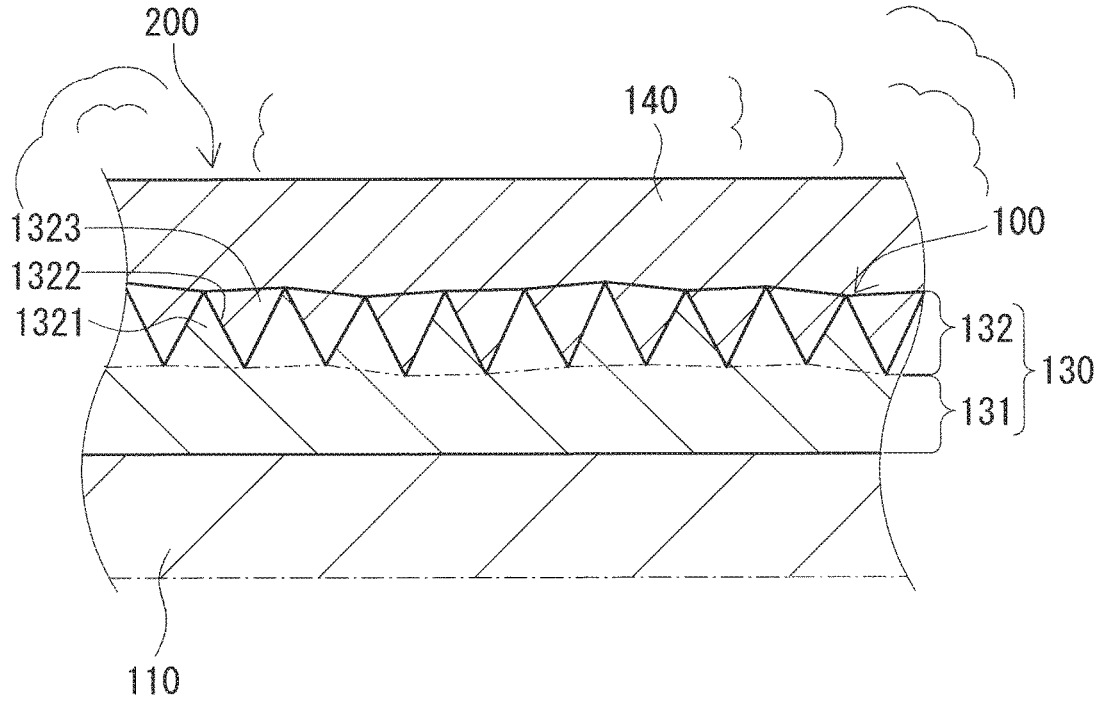
FIG. 4 is an explanatory diagram illustrating applying heat treatment in the method for manufacturing a metal material according to an embodiment.

The details of the embodiments of the present disclosure will be described below with reference to drawings. Each figure illustrates a form in which a metal material 1 is constituted by a wire rod. Metal material 1 shown in each figure is illustrated by a cross section obtained by cutting the same along a plane parallel to the longitudinal direction of the wire rod. In FIGS. 1, 3, and 4, only one half of metal material 1 in the radial direction is shown in the cross section of metal material 1, but the other half has the same constitution. In FIGS. 1, 3, and 4, the thickness of the oxide layer with respect to the base material is exaggerated for the sake of clarity and is different from the actual size. In addition, in FIGS. 1, 3, and 4, the constitution of the composite layer included in the oxide layer is schematically shown for the sake of clarity. The same reference signs in the figures indicate the same names.

<Metal Material>

As shown in FIG. 1, metal material 1 of the embodiment includes a base material 2, an oxide layer 3 disposed on the surface of base material 2, and a metal layer 4 disposed on the surface of oxide layer 3. Base material 2 includes aluminum. Oxide layer 3 includes aluminum, nickel, and oxygen. Metal layer 4 includes nickel. One of the features of metal material 1 of the embodiment is that the average thickness of oxide layer 3 is no less than 50 nm and no more than 250 nm. Hereinafter, the details of metal material 1 will be described.

The direction in which oxide layer 3 and metal layer 4 are disposed with respect to base material 2 may be referred to as a lamination direction. The lamination direction is a direction that, when a cross section of metal material 1 is taken such that the surface of base material 2 is a straight line, is orthogonal to the straight line. When base material 2 is a wire rod, the lamination direction is the radial direction of the wire rod. When base material 2 is a plate material, the lamination direction is the thickness direction thereof. The lamination direction is the vertical direction in FIG. 1.

[Base Material]

Base material 2 is made of aluminum or an aluminum alloy. "Aluminum (Al)" as used here refers to pure aluminum containing no less than 99% by mass of Al. As the pure Al, for example, 1000 series aluminum specified for in JIS H 4000 (2014) can be used. As the 1000 series aluminum, A1070 can be used. The "aluminum (Al) alloy" as used here refers to an aluminum-based alloy containing no less than 50% by mass and preferably no less than 90% by mass of Al, and containing at least one doped element other than Al. Examples of the doped elements of the Al alloy include iron (Fe), magnesium (Mg), silicon (Si), copper (Cu), zinc (Zn), nickel (Ni), manganese (Mn), silver (Ag), chromium (Cr), and zirconium (Zr). The total content of the doped elements may be no less than 1% by mass and less than 50% by mass, and further no less than 1% by mass and less than 10% by mass. When Mg is included as the doped element, the content of Mg may be no less than 0.4% by mass and no more than 5% by mass. As such an Al alloy, various alloys, for example, a 5000 series aluminum alloy, specified for in JIS H 4000 (2014) can be used. As the 5000 series aluminum, A5052 can be used. Base material 2 may be a wrought material or a cast material.

As the shape of base material 2, a wire rod, a plate material, a bar material, a pipe, a foil, or any other desired shape can be appropriately selected. Base material 2 of the present example is a wire rod. For the dimensions of base material 2, various dimensions can be appropriately selected depending on the intended use.

The average thickness of base material 2 may be no less than 0.04 mm and no more than 5 mm. When base material 2 is a wire rod or a bar material, the average thickness of base material 2 refers to the diameter thereof. When base material 2 is a tube, the average thickness of base material 2 is ½ of the difference between the inner diameter and the outer diameter. When the average thickness of base material 2 is no less than 0.04 mm, the strength of the base material is easily maintained, and metal material 1 excellent in bending resistance is easily obtained. On the other hand, when the average thickness of base material 2 is no more than 5 mm, the bending workability of metal material 1 is easily improved. The average thickness of base material 2 may be further no less than 0.1 mm and no more than 3 mm and particularly no less than 0.5 mm and no more than 2 mm.

The surface of base material 2 on which oxide layer 3 is disposed may be a substantially flat plane. The substantially flat plane means a surface state in which the roughness is no more than ⅓ of the difference in unevenness between a protrusion 321 and a depression 322 in a composite layer 32 described later. The difference in unevenness between protrusion 321 and depression 322 can be regarded as the thickness of composite layer 32. When the surface of base material 2 on which oxide layer 3 is disposed is a flat plane, the surface thereof may further have no more than ¼ and particularly no more than ⅕ of the above difference in unevenness. The surface state, in terms of the roughness, of the surface of base material 2 on which oxide layer 3 is disposed can be measured by cross-sectional observation using a scanning electron microscope (SEM).

The surface of base material 2 on which oxide layer 3 is disposed may be formed in an uneven shape. The uneven shape means a surface state in which the roughness is more than ⅓ of the difference in unevenness between protrusion 321 and depression 322 in composite layer 32 described later. When the surface is formed in the uneven shape, oxide layer 3 is disposed in such a way as to fit into the protrusion and depression of the surface. That is, the interface at which base material 2 and the oxide layer 3 are in contact with each other is formed in an uneven shape. When the interface is formed in the uneven shape, the close adhesion between base material 2 and oxide layer 3 is easily improved by the anchor effect. When the surface of base material 2 on which oxide layer 3 is disposed is formed in the uneven shape, the surface may further have no more than ½ of the above difference in unevenness and particularly almost the same one.

[Oxide Layer]

Oxide layer 3 is disposed on the surface of base material 2. Oxide layer 3 includes aluminum, nickel, and oxygen. Oxide layer 3 is mainly made of aluminum oxide. Oxide layer 3 includes a base layer 31 and composite layer 32. Oxide layer 3 of the present example has a two-layer structure consisting of base layer 31 and composite layer 32.

The content of oxygen included in oxide layer 3 may be no less than 20 atomic % and no more than 55 atomic %, further no less than 22 atomic % and no more than 45 atomic %, and particularly no less than 25 atomic % and no more than 35 atomic %. When the content of oxygen included in oxide layer 3 satisfies the above range, the close adhesion between base material 2 and metal layer 4 is easily improved.

<Base Layer>

Base layer 31 is disposed on the base material 2 side. Base layer 31 has a higher content of aluminum than that of nickel. Because base layer 31 includes a large amount of aluminum, the close adhesion between base material 2 and oxide layer 3 is easily improved. The content of aluminum included in base layer 31 may be no less than 30 atomic % and no more than 60 atomic %, further no less than 35 atomic % and no more than 55 atomic %, and particularly no less than 40 atomic % and no more than 50 atomic %. When the content of aluminum included in base layer 31 satisfies the above range, the close adhesion between base material 2 and oxide layer 3 is easily improved. When base material 2 is made of an aluminum alloy, base layer 31 preferably includes a doped element included in the aluminum alloy. Base layer 31 is mainly made of aluminum oxide.

The average thickness of base layer 31 may be no less than 30 nm and no more than 230 nm. When the average thickness of base layer 31 is no less than 30 nm, the close adhesion between base material 2 and oxide layer 3 is easily improved. On the other hand, when the average thickness of base layer 31 is no more than 230 nm, the thickness of composite layer 32 can be relatively secured to some extent. The average thickness of base layer 31 may be further no less than 40 nm and no more than 150 nm and particularly no less than 50 nm and no more than 100 nm. The average thickness of base layer 31 can be determined from a SEM image obtained by observing a cross section of metal material 1 using an SEM. The magnification of the SEM image may be no less than 50,000×. In this SEM image, the thickness of base layer 31 is measured at 10 different points, and the average value thereof is taken as the average thickness of base layer 31. The thickness of base layer 31 is the length along the lamination direction of each layer from the surface of base material 2 to the boundary between base layer 31 and composite layer 32. The boundary between base layer 31 and composite layer 32 will be described later.

<Composite Layer>

Composite layer 32 is disposed on the metal layer 4 side. Composite layer 32 has a higher content of nickel than that of aluminum. Because composite layer 32 includes a large amount of nickel, the close adhesion between oxide layer 3 and metal layer 4 is easily improved. The content of nickel included in composite layer 32 may be no less than 25 atomic % and no more than 70 atomic %, further no less than 32 atomic % and no more than 60 atomic %, and particularly no less than 35 atomic % and no more than 50 atomic %. When the content of nickel included in composite layer 32 satisfies the above range, the close adhesion between oxide layer 3 and metal layer 4 is easily improved. Composite layer 32 of the present example is constituted by a composite of a plurality of protrusions 321 and metal portions 323.

(Protrusion)

The plurality of protrusions 321 protrude from base layer 31. A depression 322 is disposed between adjacent protrusions 321. Each protrusion 321 includes aluminum and oxygen. Each protrusion 321 is mainly made of aluminum oxide. Each protrusion 321 has substantially the same composition as base layer 31.

The protrusion height of protrusion 321 is the length along the lamination direction from the boundary between base layer 31 and composite layer 32 to the apex of protrusion 321. The boundary between base layer 31 and composite layer 32 is a line L1 connecting the most depressed points of adjacent depressions 322 with a straight line. The protrusion height of protrusion 321 may be no less than 20 nm and no more than 220 nm. Metal portion 323 exists in depression 322 disposed between adjacent protrusions 321. When the protrusion height of protrusion 321 is no less than 20 nm, a large depression 322 is easily secured, and a large contact area between depression 322 and metal portion 323 is easily secured. In addition, when the protrusion height of protrusion 321 is no less than 20 nm, the close adhesion between protrusion 321 and metal portion 323 can be increased by the anchor effect. On the other hand, when the protrusion height of protrusion 321 is no more than 220 nm, thickening of composite layer 32 can be suppressed, and the thickness of base layer 31 can be relatively secured to some extent. The protrusion height of protrusion 321 may be further no less than 30 nm and no more than 150 nm and particularly no less than 40 nm and no more than 100 nm. The protrusion height of protrusion 321 can be determined from a SEM image obtained by observing a cross section of metal material 1 using a SEM. The magnification of the SEM image may be no less than 50,000×. In this SEM image, the protrusion heights of no less than 10 protrusions 321 are measured, and the average value thereof is taken as the protrusion height of protrusions 321. This protrusion height is the length of a straight line drawn from the apex to the base in the above SEM image, wherein the straight line is along the lamination direction and passes through the apex of protrusions 321 and the bases of protrusions 321.

The distance between the apexes of adjacent protrusions 321 may be no less than 5 nm and no more than 80 nm. When the distance between the apexes of adjacent protrusions 321 is no less than 5 nm, a large contact area between metal portion 323 and metal layer 4 is easily secured, and the close adhesion between oxide layer 3 and metal layer 4 is easily improved. On the other hand, when the distance between the apexes of adjacent protrusions 321 is no more than 80 nm, many protrusions 321 and depressions 322 are easily disposed, and the close adhesion between protrusions 321 and metal portions 323 is easily increased by the anchor effect. The distance between the apexes of adjacent protrusions 321 may be further no less than 10 nm and no more than 60 nm and particularly no less than 15 nm and no more than 40 nm.

(Metal Portion)

Metal portion 323 is interposed between adjacent protrusions 321. Each metal portion 323 includes nickel. Each metal portion 323 is mainly made of simple substance of nickel. Metal portion 323 contributes to improving the close adhesion to metal layer 4. Metal portion 323 is typically disposed in a region formed by a line L2 connecting the apexes of adjacent protrusions 321 and depression 322.

The average thickness of composite layer 32 may be no less than 20 nm and no more than 220 nm. When composite layer 32 is constituted by a composite of protrusion 321 and metal portion 323, the average thickness of composite layer 32 corresponds to the protrusion height of protrusion 321. When the average thickness of composite layer 32 is no less than 20 nm, the close adhesion between oxide layer 3 and metal layer 4 is easily improved. On the other hand, when the average thickness of composite layer 32 is no more than 220 nm, the thickness of base layer 31 can be relatively secured to some extent. The average thickness of composite layer 32 may be further no less than 40 nm and no more than 150 nm and particularly no less than 50 nm and no more than 100 nm. The average thickness of composite layer 32 can be determined from a SEM image obtained by observing a cross section of metal material 1 using a SEM. The magnification of the SEM image may be 50,000×. In this SEM image, the thickness of composite layer 32 is measured at 10 different points, and the average value thereof is taken as the average thickness of composite layer 32. The thickness of composite layer 32 is the protrusion height of protrusion 321.

<Average Thickness>

The average thickness of oxide layer 3 is no less than 50 nm and no more than 250 nm. Because oxide layer 3 is no less than 50 nm, mutual diffusion of aluminum included in base material 2 and nickel included in metal layer 4 can be suppressed even in a high temperature environment of no less than 300° C. Because the mutual diffusion of aluminum and nickel can be suppressed, the formation of a Kirkendall void in a surface layer region of base material 2 can be suppressed. Because the formation of a Kirkendall void can be suppressed, metal material 1 is excellent in heat resistance. On the other hand, because oxide layer 3 is no more than 250 nm, reduction in the bending workability of metal material 1 can be suppressed. The average thickness of oxide layer 3 may be further no less than 75 nm and no more than 200 nm, no less than 100 nm and no more than 150 nm, and particularly more than 100 nm and no more than 150 nm.

The average thickness of oxide layer 3 can be determined from a SEM image obtained by observing a cross section of metal material 1 using a scanning electron microscope (SEM). The magnification of the SEM image may be 50,000×. In this SEM image, the thickness of oxide layer 3 is measured at 10 different points, and the average value thereof is taken as the average thickness of oxide layer 3. The thickness of oxide layer 3 is the length in the lamination direction between the interface between base material 2 and oxide layer 3 and the interface between oxide layer 3 and metal layer 4. When oxide layer 3 has a two-layer structure consisting of base layer 31 and composite layer 32, the thickness of oxide layer 3 is the sum of the thickness of base layer 31 and the thickness of composite layer 32.

When base material 2 is a wire rod, the proportion of the average thickness of oxide layer 3 to the diameter of base material 2 may be no less than 0.00005 and no more than 0.0025. When the above proportion is no less than 0.00005, the thickness of oxide layer 3 is secured to some extent, and the heat resistance is easily improved. On the other hand, when the above proportion is no more than 0.0025, the thickness of oxide layer 3 is not too large, and the bending workability of metal material 1 is easily improved. The above proportion may be further no less than 0.00008 and no more than 0.001 and particularly no less than 0.00012 and no more than 0.0002.

<Others>

Oxide layer 3 may include a plurality of dispersed pores 35. Pores 35 are dispersed and present mainly in base layer 31 and protrusions 321. When the plurality of pores 35 are dispersed in oxide layer 3, the bending workability of metal material 1 is easily improved. The size of pores 35 may be no less than 1 nm and no more than 50 nm. When the size of pores 35 is no less than 1 nm, the bending workability of metal material 1 is easily improved. On the other hand, when the size of pores 35 is no more than 50 nm, brittle fracture is suppressed. The size of pores 35 may be further no less than 5 nm and no more than 40 nm and particularly no less than 10 nm and no more than 30 nm. The size of pores 35 can be determined from a SEM image obtained by observing a cross section of metal material 1 using a SEM. The magnification of the SEM image may be 50,000×. In this SEM image, the equivalent circle diameter of pore 35 is taken as the diameter, and the average value of the diameters of no less than 10 pores 35 is taken as the size of pores 35. The equivalent circle diameter as used here refers to the diameter of a perfect circle having the area of a cross section of pore 35.

The area proportion of pores 35 to oxide layer 3 in the cross section of metal material 1 may be no less than 1% and no more than 20%. When the area proportion is no less than 1%, the bending workability of metal material 1 is easily improved. On the other hand, when the area proportion is no more than 20%, brittle fracture is suppressed. The area proportion may be further no less than 3% and no more than 15% and particularly no less than 5% and no more than 10%. The area proportion can be determined from a SEM image obtained by observing a cross section of metal material 1 using a SEM. The magnification of the SEM image may be 50,000×. In this SEM image, the proportion of the total area of pores 35 to the area of oxide layer 3 is taken as the above area proportion.

[Metal Layer]

Metal layer 4 is disposed on the surface of oxide layer 3. Metal layer 4 includes nickel. Metal layer 4 is mainly made of simple substance of nickel.

The average thickness of metal layer 4 may be no less than 3 μm and no more than 15 μm. When the average thickness of metal layer 4 is no less than 3 μm, the heat resistance is easily improved. On the other hand, when the average thickness of metal layer 4 is no more than 15 μm, the bending workability of metal material 1 is easily improved. The average thickness of metal layer 4 may be further no less than 4 and no more than 12 μm and particularly no less than 6 μm and no more than 10 The average thickness of metal layer 4 can be determined from a SEM image obtained by observing a cross section of metal material 1 using a SEM. The magnification of the SEM image may be 50,000×. In this SEM image, the thickness of metal layer 4 is measured at 10 different points, and the average value thereof is taken as the average thickness of metal layer 4. The thickness of metal layer 4 is the length in the lamination direction from the interface between oxide layer 3 and metal layer 4 to the surface of metal layer 4. When oxide layer 3 has a two-layer structure consisting of base layer 31 and composite layer 32, the interface between oxide layer 3 and metal layer 4 is a line L2 connecting the apexes of adjacent protrusions 321 with a straight line.

When base material 2 is a wire rod, the proportion of the average thickness of metal layer 4 to the diameter of base material 2 may be no less than 0.003 and no more than 0.075. When the above proportion is no less than 0.003, the thickness of metal layer 4 is secured to some extent, and the heat resistance is easily improved. On the other hand, when the above proportion is no more than 0.075, the thickness of metal layer 4 is not too large, and the bending workability of metal material 1 is easily improved. The above proportion may be further no less than 0.004 and no more than 0.04 and particularly no less than 0.005 and no more than 0.012.

<Other>

Metal material 1 may further include another metal layer on the surface of metal layer 4.

[Applications]

Metal material 1 of the embodiment can be suitably used for an application involving use in a high temperature environment and an application involving heat treatment. Examples of such applications include a capacitor mounted on an electronic device, a battery lead wire, a bump connecting electronic devices, and an automobile part.

<Method for Manufacturing Metal Material>

The method for manufacturing a metal material according to an embodiment includes providing a base material, disposing a precursor layer, disposing a metal layer, and applying heat treatment. Hereinafter, with reference to FIGS. 2 to 4, the details of the method for manufacturing a metal material will be described.

[Providing]

In providing, a base material 110 including aluminum is provided. Base material 110 is the same as base material 2 described above. In the present example, base material 110 is a wire rod.

[Disposing Precursor Layer]

Figure 2:
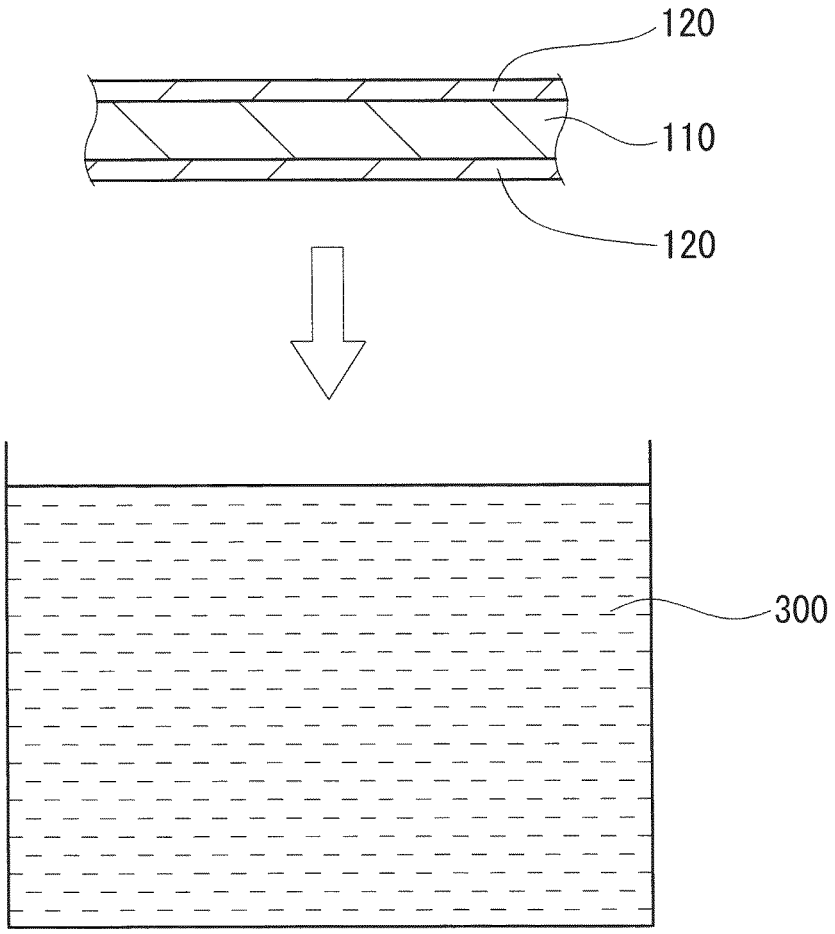
FIG. 2 is an explanatory diagram illustrating disposing a precursor layer in the method for manufacturing a metal material according to an embodiment.

In disposing a precursor layer, a precursor layer 130 including aluminum and nickel is disposed on the surface of base material 110 to prepare a first coating material 100 (FIG. 3). As shown in FIG. 2, disposing a precursor layer includes forming a thin film 120 including aluminum oxide on the surface of base material 110 and applying electroless plating to base material 110 on which thin film 120 is formed, using a nickel plating solution 300.

<Forming Thin Film>

When base material 110 includes aluminum, a pretreatment is generally applied to base material 110 before plating is applied to base material 110. The pretreatment includes at least one of degreasing, etching, and desmutting. In the present example, as the pretreatment, all of degreasing, etching, and desmutting are carried out. The degreasing is a treatment that removes the oil adhering to the surface of base material 110. The degreasing is carried out using, for example, an alkaline degreasing agent. The etching is a treatment that removes the aluminum oxide film formed on the surface of base material 110. The etching is carried out using, for example, a highly alkaline aqueous solution including sodium hydroxide or the like. The desmutting is a treatment that removes the smut generated during etching. The smut refers to an impurity included in aluminum hydroxide ($Al(OH)_3$) or an aluminum alloy. The desmutting is carried out using, for example, an acidic aqueous solution including nitric acid or the like.

Thin film 120 can be obtained by applying the pretreatment described above to base material 110. The average thickness of thin film 120 may be no less than 1 nm and no more than 10 nm. When the average thickness of thin film 120 satisfies the above range, a base layer 131 and a protrusion 1321 (FIG. 3) in a composite layer 132 constituting precursor layer 130 can be constituted well. The average thickness of thin film 120 may be further no less than 1.5 nm and no more than 7 nm and particularly no less than 2 nm and no more than 5 nm. The average thickness of thin film 120 can be measured by elemental analysis in the depth direction by X-ray photoelectron spectroscopy (XPS).

<Applying Electroless Plating>

In applying electroless plating, as shown in FIG. 2, base material 110 on which thin film 120 is formed is immersed in nickel plating solution 300. Nickel plating solution 300 has a pH of more than 9 and less than 11 at 25° C. By applying electroless plating using an alkaline nickel plating solution 300 having a relatively high pH, precursor layer 130 (FIG. 3) including a large amount of metal hydroxide can be disposed on the surface of base material 110. The metal hydroxide included in precursor layer 130 is converted into a metal oxide by heat treatment described later. Although the details will be described later, precursor layer 130 is transformed into oxide layer 3 (FIG. 1) by converting the metal hydroxide into the metal oxide. By including a large amount of metal hydroxide in precursor layer 130, the metal hydroxide can be converted well into the metal oxide by heat treatment described later, and a relatively thick oxide layer 3 can be obtained. The pH of nickel plating solution 300 may be further no less than 10 and particularly no less than 10.5.

The temperature of nickel plating solution 300 during the electroless plating treatment may be no less than 20° C. and no more than 100° C. The treatment time of electroless plating may be no less than 1 minute and no more than 20 minutes and further no less than 2 minutes and no more than 10 minutes.

Nickel plating solution 300 includes a nickel compound that is a source of a nickel ion. Examples of the nickel compound include nickel sulfate, nickel chloride, and nickel nitrate. The concentration of the nickel compound may be, for example, no less than 0.1 g/L and no more than 50 g/L.

Nickel plating solution 300 can include an additive such as a reducing agent, a complexing agent, a pH buffering agent, a brightening agent, or a surfactant, in addition to the nickel compound. The reducing agent is a compound that reduces a nickel ion.

Examples of the reducing agent include sodium hypophosphite, a boron compound, and a hydrazine compound. The complexing agent is a compound that forms a complex with a metal ion in nickel plating solution 300 and stabilizes the complex. The complexing agent can be appropriately selected depending on the type of a metal salt. Examples of the complexing agent include an ammonium salt of sulfuric acid, phosphoric acid, hydrochloric acid, or the like, sulfamic acid, glycine, ethylenediamine, ethylenediaminetetraacetic acid, and an organic carboxylic acid. The pH buffering agent is a compound that prevents the precipitation of a metal ion. Examples of the pH buffering material include boric acid, acetic acid, and citric acid. The brightening agent is a compound that smooths the surface of the layer obtained. Examples of the brightening agent include saccharine sodium, sodium naphthalenedisulfonate, sodium sulfate, and butynediol. Examples of the surfactant include sodium dodecyl sulfate and polyoxyethylene alkyl ether. The concentration of the additive is not particularly limited.

By applying electroless plating, as shown in FIG. 3, first coating material 100 including precursor layer 130 on the surface of base material 110 can be obtained. Precursor layer 130 has a two-layer structure consisting of base layer 131 and composite layer 132. Composite layer 132 is constituted by a composite of a plurality of protrusions 1321 and metal portions 1323. The mechanism by which such a precursor layer 130 is formed by applying electroless plating is considered as follows.

First, a part of thin film 120 is dissolved by nickel plating solution 300 to expose the surface of base material 110. On the exposed surface of base material 110, the aluminum constituting base material 110 is replaced with nickel. In addition, the exposed surface of base material 110 is oxidized. On the other hand, the remainder of thin film 120 that has not been dissolved protrudes as compared with the dissolved portion. In addition, the remainder of thin film 120 that has not been dissolved partially grows because of the formation of a new aluminum oxide film on thin film 120. The remainder of thin film 120 that has not been dissolved protrudes as compared with the other portions, and the protruding portions serves as the plurality of protrusions 1321. The portion other than the protruding portions of thin film 120 serves as base layer 131. The dissolution and growth of thin film 120 take place, and nickel is disposed in a depression 1322 disposed between the plurality of protrusions 1321. The nickel disposed in such a way as to fill depression 1322 serves as metal portions 1323.

Precursor layer 130 is mainly made of a hydroxide. Base layer 131 and protrusions 1321 are mainly derived from thin film 120. Therefore, base layer 131 and protrusions 1321 are mainly made of aluminum hydroxide. Metal portions 1323 are mainly derived from the nickel compound contained in nickel plating solution 300. Therefore, metal portions 1323 are mainly made of nickel hydroxide or simple substance of nickel.

[Disposing Metal Layer]

In disposing a metal layer, a metal layer 140 including nickel is disposed on the surface of precursor layer 130 to prepare a second coating material 200 (FIG. 4). Metal layer 140 can be formed by applying plating. The plating may be electroless plating or electrolytic plating.

In the case of electroless plating, a known plating solution allowing for electroless nickel plating can be used.

In the case of electrolytic plating, a known nickel plating solution can be used. Examples of the nickel plating solution used for electrolytic plating include a Watts bath containing nickel sulfate, nickel chloride, and boric acid as main components, a sulfamate bath containing nickel sulfate and boric acid as main components, a Wood's bath containing nickel chloride and hydrochloric acid as main components, and a black bath containing nickel sulfate, nickel ammonium sulfate, zinc sulfate, and sodium thiocyanate as main components. The conditions for electrolytic plating are not particularly limited. The current density may be, for example, no less than 0.1 $A/dm^2$ and no more than 20 $A/dm^2$. The temperature of the nickel plating solution during the electrolytic plating treatment may be, for example, no less than 20° C. and no more than 70° C. The treatment time of electrolytic plating can be appropriately set depending on the desired thickness.

By disposing a metal layer, second coating material 200 including metal layer 140 on the surface of precursor layer 130 can be obtained, as shown in FIG. 4. Metal layer 140 is the same as metal layer 4 described above.

After disposing a metal layer, another metal layer may be formed on the surface of metal layer 140. Examples of the other metal layer include a tin-plated layer.

[Heat Treatment]

In the heat treatment, heat treatment is applied to base material 110 on which precursor layer 130 and metal layer 140 are disposed, as shown in FIG. 4. By this heat treatment, the metal hydroxide included in precursor layer 130 is converted into a metal oxide. That is, by this heat treatment, precursor layer 130 is transformed into oxide layer 3 (FIG. 1) including aluminum, nickel, and oxygen. In addition, this heat treatment increases the thickness of oxide layer 3. It should be noted that this heat treatment does not substantially affect base material 110 and metal layer 140. Base material 2 and metal layer 4 in metal material 1 obtained after the heat treatment substantially maintain the composition, thickness, and the like of base material 110 and metal layer 140 in the manufacturing process.

The heat treatment temperature is no less than 400° C. and no more than 600° C. Because the heat treatment temperature is no less than 400° C., the metal hydroxide included in precursor layer 130 is converted well into a metal oxide. In addition, because the heat treatment temperature is no less than 400° C., the average thickness of oxide layer 3 formed (FIG. 1) is easily set to no less than 50 nm. On the other hand, because the heat treatment temperature is no more than 600° C., the average thickness of oxide layer 3 formed is easily set to no more than 250 nm. The heat treatment temperature may be further no less than 420° C. and no more than 550° C. and particularly no less than 450° C. and no more than 500° C.

The heat treatment time may be no less than 30 seconds and no more than 60 minutes. When the heat treatment time is no less than 30 seconds, the metal hydroxide included in precursor layer 130 is converted well into a metal oxide. In addition, when the heat treatment time is no less than 30 seconds, the average thickness of oxide layer 3 formed (FIG. 1) is easily set to no less than 50 nm. On the other hand, when the heat treatment time is no more than 60 minutes, the average thickness of oxide layer 3 formed is easily set to no more than 250 nm. The heat treatment time may be further no less than 5 minutes and no more than 30 minutes and particularly no less than 10 minutes and no more than 15 minutes.

The heat treatment atmosphere may be an inert gas atmosphere such as an argon atmosphere or a nitrogen atmosphere.

Depending on the heat treatment temperature and the heat treatment time described above, pores 35 (FIG. 1) may be dispersed and formed on base layer 31 and/or protrusions 321 in metal material 1 obtained after the heat treatment.

<Effects>

In metal material 1 of the embodiment, oxide layer 3 is interposed between base material 2 and metal layer 4. Oxide layer 3 includes aluminum, which is a metal component of base material 2, nickel, which is a metal component of metal layer 4, and oxygen. Because of the interposition of oxide layer 3, metal material 1 of an embodiment 1 is excellent in the close adhesion between base material 2 and metal layer 4. In particular, because oxide layer 3 is no less than 50 nm, mutual diffusion of aluminum included in base material 2 and nickel included in metal layer 4 can be suppressed even in a high temperature environment of no less than 300° C. Because the mutual diffusion of aluminum and nickel can be suppressed, the formation of a Kirkendall void in a surface layer region of base material 2 can be suppressed. Because the formation of a Kirkendall void can be suppressed, metal material 1 of the embodiment is excellent in heat resistance. On the other hand, because oxide layer 3 is no more than 250 nm, reduction in the bending workability of metal material 1 can be suppressed.

In the method for manufacturing a metal material according to the embodiment, precursor layer 130 including a large amount of a metal hydroxide is disposed on the surface of base material 110, and then heat treatment is applied. Precursor layer 130 including a large amount of a metal hydroxide can be obtained by applying electroless plating using an alkaline nickel plating solution having a relatively high pH. The metal hydroxide included in precursor layer 130 is converted into a metal oxide by heat treatment. Because the heat treatment temperature is no less than 400° C., the metal hydroxide is converted well into the metal oxide, and the average thickness of oxide layer 3 formed is easily set to no less than 50 nm. On the other hand, because the heat treatment temperature is no more than 600° C., the average thickness of oxide layer 3 formed is easily set to no more than 250 nm. Thus, according to the method for manufacturing a metal material according to the embodiment, metal material 1 including base material 2, oxide layer 3 disposed on the surface of base material 2, and metal layer 4 disposed on the surface of oxide layer 3 can be obtained. In particular, by applying electroless plating using an alkaline nickel plating solution having a relatively high pH to dispose precursor layer 130 and then applying heat treatment at a specific temperature, oxide layer 3 which is relatively thick and has an average thickness of no less than 50 nm and no more than 250 nm is easily obtained.

TEST EXAMPLES

A metal material including a base material including aluminum, a metal layer including nickel, and an oxide layer between the base material and the metal layer was prepared, and the close adhesion in the metal material was investigated.

Test Example 1

In Test Example 1, nickel plating solutions having different pH were used in disposing a precursor layer which is the origin of the oxide layer, and the structure and thickness of the oxide layers obtained and the close adhesion in the metal material were investigated.

[Preparation of Samples]

Sample No. 1-1 to No. 1-5

First, a wire rod made of A1070 according to a JIS standard was provided as a base material. The diameter of the base material is 5 mm.

A pretreatment was applied to the provided base material. As the pretreatment, all of degreasing, etching, and desmutting were carried out. In the sample product obtained by applying the pretreatment to the wire rod made of A1070, a thin film made of aluminum oxide having a thickness of about 3 nm was formed.

The base material on which the thin film was formed was immersed in a nickel plating solution to apply electroless plating. The nickel plating solution includes nickel sulfate hexahydrate and glycine. The concentration of nickel sulfate hexahydrate was 25 g/L. The concentration of glycine was 30 g/L. The pH of the nickel plating solution at 25° C. was the pH shown in Table 1. Such nickel plating solution was kept at 60° C., and the base material on which the thin film was formed was immersed for 2 minutes.

A precursor layer is formed on the surface of the base material by the above pretreatment and electroless plating.

Next, electrolytic plating was applied using a Watts bath to the base material on which the precursor layer was formed. The temperature of the Watts bath was 55° C. The current density of the electrolytic plating was 5 A/dm$^2$. The electrolytic plating was carried out until a metal layer having the desired thickness was formed on the surface of the precursor layer. The average thickness of the metal layer was 15 μm.

Next, heat treatment was applied to the base material on which the precursor layer and the metal layer were formed.

The heat treatment temperature was 600° C. The heat treatment time was 30 seconds. The heat treatment atmosphere was an argon atmosphere.

Sample No. 1-11 to No. 1-15

First, a wire rod made of A5052 according to a JIS standard was provided as a base material. The diameter of the base material is 0.2 mm.

A pretreatment was applied to the provided base material. The pretreatment is the same as for sample No. 1-1 and the like. In the sample product obtained by applying the pretreatment to the wire rod made of A5052, a thin film made of aluminum oxide having a thickness of about 3 nm was formed.

The base material on which the thin film was formed was immersed in a nickel plating solution to apply electroless plating. The conditions for the nickel plating solution and the electroless plating are the same as for sample No. 1-1 and the like.

A precursor layer is formed on the surface of the base material by the above pretreatment and electroless plating.

Next, electrolytic plating was applied using a Watts bath to the base material on which the precursor layer was formed. The conditions for the Watts bath and the electrolytic plating are the same as for sample No. 1-1 and the like. The average thickness of the metal layer was 3 μm.

Next, heat treatment was applied to the base material on which the precursor layer and the metal layer were formed. The conditions for heat treatment are the same as for sample No. 1-1 and the like. That is, the heat treatment was carried out at 600° C. for 30 seconds in an argon atmosphere.

[Structure and Thickness of Oxide Layer]

A cross section of the metal material of each sample obtained was observed using a SEM, and the composition was analyzed using an energy dispersive X-ray analyzer (EDX). As a result, it was confirmed that all the samples included a base layer having a relatively high content of aluminum on the base material side and a composite layer having a relatively high content of nickel on the metal layer side. The content of aluminum and nickel in each layer were determined by carrying out composition analysis on 5 regions in the oxide layer in which each layer fits, and using the average value thereof. Each content of aluminum (Al) and nickel (Ni) in the base layer and the composite layer are shown in Table 1. It should be noted that although not shown in Table 1, oxygen (O) was included in the base layer and the composite layer in addition to Al and Ni. In addition, although not shown in Table 1, magnesium (Mg) was further included in the base layer in the range of no less than 0.4% by mass and no more than 5% by mass in sample No. 1-11 to No. 1-15.

It was confirmed that the composite layer included a plurality of protrusions protruding from the base layer and a metal portion interposed in a depression disposed between adjacent protrusions. The base layer and the protrusions were mainly made of aluminum oxide. The metal portion was mainly made of nickel. Because the composite layer includes a metal portion, the content of nickel is higher than that of aluminum.

The thicknesses of the base layer and the composite layer were determined as follows. First, in a SEM image, the most depressed points of adjacent depressions are connected with a straight line, which is designated as a line L1 and taken as the boundary between the base layer and the composite layer. In addition, the apexes of adjacent protrusions 321 are connected with a straight line, which is designated as a line L2 and is taken as the boundary between the composite layer and the metal layer. The thickness of the base layer was determined by measuring the length in the lamination direction between the surface of the base material and the line L1 at 10 different points and using the average value thereof. The thickness of the composite layer was determined by measuring the length in the lamination direction between the line L1 and the L2 at 10 different points and using the average value thereof. The thicknesses of the base layer and the composite layer are shown in Table 1.

[Close Adhesion Evaluation 1]

The metal material of each sample obtained was heated at 500° C. for 10 minutes and then cooled to room temperature. The heated and cooled metal material was wound around a stainless steel jig. As the jig, a wire rod, a round bar material, or the like can be used. In the present example, a plurality of wire rods having different diameters were provided as jigs. The appearance of the metal material was observed using a stereomicroscope, and the presence or absence of peeling of the metal layer was investigated. Specifically, the diameter of the jig was gradually minified, and the radius of curvature of the metal material when the peeling of the metal layer in the metal material wound around the jig was confirmed for the first time was investigated. The radius of curvature of the metal material is the sum of the radius of the base material and the radius of the jig. The radius of curvature of the metal material when the peeling of the metal layer is confirmed for the first time is referred to as the critical radius of curvature of bending workability. The ratio R/D of the critical radius of curvature R of the bending radius to the radius D of the base material was determined. The smaller the ratio R/D, the better the close adhesion. When R/D is no more than 1, an A rating is given; when R/D is more than 1 and no more than 3, a B rating is given; when R/D is more than 3 and no more than 5, a C rating is given; and when R/D is more than 5, a D rating is given. In particular, when R/D is no more than 0.75, an A+ rating is given. The results are shown in Table 1.

It should be noted that in close adhesion evaluation 1, heating was carried out at 500° C. for 10 minutes. Therefore, in close adhesion evaluation 1, excellent close adhesion is equivalent to excellent heat resistance. In addition, in close adhesion evaluation 1, bending work was applied to the metal material. Therefore, in close adhesion evaluation 1, excellent close adhesion is equivalent to excellent bending workability.

TABLE 1

| Sample No. | Base material | Nickel plating solution pH | Oxide layer Average thickness (nm) | Base layer Composition Al (at %) | Base layer Composition Ni (at %) | Base layer Average thickness (nm) | Composite layer Composition Al (at %) | Composite layer Composition Ni (at %) | Composite layer Average thickness (nm) | Close adhesion evaluation 1 |
|---|---|---|---|---|---|---|---|---|---|---|
| 1-1 | A1070 | 9.0 | 30 | 43 | 25 | 10 | 32 | 42 | 20 | B |
| 1-2 | | 9.5 | 50 | 50 | 15 | 25 | 25 | 48 | 25 | A |
| 1-3 | | 10.0 | 90 | 48 | 21 | 55 | 28 | 39 | 35 | A |

TABLE 1-continued

| Sample No. | Base material | Nickel plating solution pH | Oxide layer Average thickness (nm) | Base layer Composition Al (at %) | Base layer Composition Ni (at %) | Base layer Average thickness (nm) | Composite layer Composition Al (at %) | Composite layer Composition Ni (at %) | Composite layer Average thickness (nm) | Close adhesion evaluation 1 |
|---|---|---|---|---|---|---|---|---|---|---|
| 1-4 | | 10.5 | 150 | 42 | 18 | 100 | 29 | 43 | 50 | A+ |
| 1-5 | | 11.0 | 260 | 48 | 32 | 190 | 35 | 49 | 70 | C |
| 1-11 | A5052 | 9.0 | 40 | 40 | 28 | 15 | 33 | 50 | 25 | B |
| 1-12 | | 9.5 | 60 | 48 | 22 | 30 | 30 | 29 | 30 | A |
| 1-13 | | 10.0 | 100 | 49 | 27 | 60 | 31 | 40 | 40 | A |
| 1-14 | | 10.5 | 170 | 45 | 22 | 110 | 26 | 38 | 60 | A+ |
| 1-15 | | 11.0 | 300 | 52 | 29 | 200 | 28 | 48 | 100 | D |

As shown in Table 1, it can be seen that regardless of whether the base material is either pure aluminum or an aluminum alloy, the result of close adhesion evaluation 1 is excellent when the average thickness of the oxide layer is no less than 50 nm and no more than 250 nm. On the other hand, it can be seen that sample No. 1-1 and No. 1-11, in which the average thickness of the oxide layer is less than 50 nm, are inferior in close adhesion evaluation 1. The reason for these can be considered as follows: when the average thickness of the oxide layer was less than 50 nm, aluminum included in the base material and nickel included in the metal layer were easily mutually diffused by heating at 500° C., leading to the formation of a Kirkendall void in the surface layer region of the base material. In addition, it can be seen that sample No. 1-5 and No. 1-15, in which the average thickness of the oxide layer is more than 250 nm, are also inferior in close adhesion. The reason for this can be considered as follows: when the average thickness of the oxide layer is more than 250 nm, the bending workability of the metal material is inferior.

In particular, it can be seen that sample No. 1-4 and No. 1-14, in which the average thickness of the oxide layer is more than 100 nm, are quite excellent in close adhesion evaluation 1. The reason for this can be considered as follows: when the average thickness of the oxide layer is relatively thick, specifically more than 100 nm, mutual diffusion of aluminum included in the base material and nickel included in the metal layer can be suppressed well even with heating at 500° C. The following can be considered: because the above mutual diffusion can be suppressed, it is difficult for a Kirkendall void to be formed in the surface layer region of the base material and the close adhesion is excellent.

In addition, as shown in Table 1, it can be seen that the average thickness of the oxide layer depends on the pH of the nickel plating solution. Specifically, it can be seen that when the pH of the nickel plating solution is no less than 9.5, the average thickness of the oxide layer can be set to no less than 50 nm. For sample No. 1-11 and No. 1-12, in which the base material is made of an aluminum alloy, when the pH of the nickel plating solution is 9.0, the average thickness of the oxide layer is 40 nm, and when the pH of the nickel plating solution is 9.5, the average thickness of the oxide layer is 60 nm. From these, it can be thought that when the pH of the nickel plating solution is more than 9.0, the average thickness of the oxide layer can be set to no less than 50 nm. On the other hand, it can be seen that when the pH of the nickel plating solution is no more than 10.5, the average thickness of the oxide layer can be set to no more than 250 nm. For sample No. 1-14 and No. 1-15, in which the base material is made of an aluminum alloy, when the pH of the nickel plating solution is 10.5, the average thickness of the oxide layer is 170 nm, and when the pH of the nickel plating solution is 11.0, the average thickness of the oxide layer is 300 nm. From these, it can be thought that when the pH of the nickel plating solution is less than 11.0, the average thickness of the oxide layer can be set to no more than 250 nm.

Test Example 2

In Test Example 2, the heat treatment temperature and the heat treatment time were varied in applying heat treatment to convert the precursor layer into an oxide layer, and the structure and thickness of the oxide layer obtained and the close adhesion in the metal material were investigated.

[Preparation of Samples]

Sample No. 2-1 to No. 2-4

First, a wire rod made of A5052 according to a JIS standard was provided as a base material. The diameter of the base material is 2 mm.

A pretreatment was applied to the provided base material. The pretreatment is the same as for sample No. 1-1 and the like.

The base material on which the thin film was formed was immersed in a nickel plating solution to apply electroless plating. The nickel plating solution includes nickel sulfate hexahydrate and glycine. The concentration of nickel sulfate hexahydrate was 25 g/L. The concentration of glycine was 30 g/L. The pH of the nickel plating solution at 25° C. was 9.5. Such nickel plating solution was kept at 60° C., and the base material on which the thin film was formed was immersed for 2 minutes.

A precursor layer is formed on the surface of the base material by the above pretreatment and electroless plating.

Next, electrolytic plating was applied using a Watts bath to the base material on which the precursor layer was formed. The conditions for the Watts bath and the electrolytic plating are the same as for sample No. 1-1 and the like. The average thickness of the metal layer was 7 μm.

Next, heat treatment was applied to the base material on which the precursor layer and the metal layer were formed. The heat treatment temperature was 400° C. The heat treatment time was 5 minutes, 10 minutes, 30 minutes, and 60 minutes. The heat treatment atmosphere was an argon atmosphere. The heat treatment temperature and the heat treatment time are shown in Table 2.

Sample No. 2-11 to No. 2-14

Sample No. 2-11 to No. 2-14 were the same as sample No. 2-1 to No. 2-4 except that the heat treatment temperature was changed. The heat treatment temperature was 450° C.

Sample No. 2-21 to No. 2-24

Sample No. 2-21 to No. 2-24 were the same as sample No. 2-1 to No. 2-4 except that the heat treatment temperature was changed. The heat treatment temperature was 500° C.

[Structure and Thickness of Oxide Layer]

A cross section of the metal material of each sample obtained was observed using a SEM and the composition was analyzed using an EDX in the same manner as in Test Example 1. As a result, it was confirmed that all the samples included a base layer having a relatively high content of aluminum on the base material side and a composite layer having a relatively high content of nickel on the metal layer side. Each content of aluminum (Al) and nickel (Ni) in the base layer and the composite layer are shown in Table 2. In addition, it was confirmed that the composite layer included a plurality of protrusions protruding from the base layer and a metal portion interposed between adjacent protrusions. The base layer and the protrusions were mainly made of aluminum oxide. The metal portion was mainly made of nickel. Because the composite layer included a metal portion, the content of nickel is higher than that of aluminum.

The thicknesses of the base layer and the composite layer were determined in the same manner as in Test Example 1. The results are shown in Table 2.

[Close Adhesion Evaluation 1]

The close adhesion after heating and cooling of the metal material of each sample obtained was evaluated in the same manner as in Test Example 1. The results are shown in Table 2.

[Close Adhesion Evaluation 2]

The metal material of each sample obtained was wound around a stainless steel jig without heating. Close adhesion evaluation 2 and close adhesion evaluation 1 are the same except for the presence or absence of heating of the metal material. The results are shown in Table 2. It should be noted that in close adhesion evaluation 2, no heating was carried out. Therefore, in close adhesion evaluation 2, the bending workability can be evaluated, but the heat resistance cannot be evaluated.

TABLE 2

| | Heat treatment | | Oxide layer | Base layer | | | Composite layer | | | Close | Close |
|---|---|---|---|---|---|---|---|---|---|---|---|
| | | | | Composition | | | Composition | | | | |
| Sample No. | Temperature (° C.) | Time (minutes) | Average thickness (nm) | Al (at %) | Ni (at %) | Average thickness (nm) | Al (at %) | Ni (at %) | Average thickness (nm) | adhesion evaluation 1 | adhesion evaluation 2 |
| 2-1 | 400 | 5 | 50 | 39 | 20 | 20 | 24 | 40 | 30 | A | B |
| 2-2 | 400 | 10 | 60 | 44 | 18 | 32 | 29 | 39 | 28 | A | A |
| 2-3 | 400 | 30 | 75 | 42 | 29 | 50 | 28 | 42 | 25 | A | A |
| 2-4 | 400 | 60 | 95 | 48 | 18 | 73 | 30 | 36 | 22 | A | A |
| 2-11 | 450 | 5 | 65 | 42 | 13 | 25 | 23 | 51 | 40 | A | B |
| 2-12 | 450 | 10 | 90 | 46 | 22 | 60 | 19 | 43 | 30 | A | A |
| 2-13 | 450 | 30 | 120 | 43 | 31 | 100 | 25 | 42 | 20 | A+ | A |
| 2-14 | 450 | 60 | 145 | 52 | 25 | 130 | 25 | 38 | 15 | A+ | C |
| 2-21 | 500 | 5 | 95 | 44 | 11 | 40 | 29 | 48 | 55 | A | A |
| 2-22 | 500 | 10 | 135 | 43 | 23 | 95 | 22 | 45 | 40 | A+ | A |
| 2-23 | 500 | 30 | 190 | 48 | 15 | 170 | 30 | 37 | 20 | A+ | A |
| 2-24 | 500 | 60 | 230 | 44 | 32 | 220 | 28 | 40 | 10 | A+ | C |

As shown in Table 2, it can be seen that all the samples are excellent in close adhesion evaluation 1 when the average thickness of the oxide layer is no less than 50 nm and no more than 250 nm. In particular, it can be seen that sample No. 2-2 to No. 2-4, No. 2-12, No. 2-13, and No. 2-21 to No. 2-23, in which the average thickness of the base layer is no less than 30 nm and no more than 230 nm and the average thickness of the composite layer is no less than 20 nm and no more than 220 nm, are also excellent in close adhesion evaluation 2. On the other hand, it can be seen that sample No. 2-1 and No. 2-11, in which the average thickness of the base layer is less than 30 nm, are inferior in close adhesion evaluation 2. It can be considered that this is because the small average thickness of the base layer reduced the close adhesion between the base material and the oxide layer. In addition, it can be seen that sample No. 2-14 and No. 2-24, in which the average thickness of the composite layer is less than 20 nm, are inferior further in close adhesion evaluation 2. It can be considered that this is because the small average thickness of the composite layer reduced the close adhesion between the oxide layer and the metal layer. It can be considered that the close adhesion between the oxide layer and the metal layer has a greater degree of reduction in bending workability than the close adhesion between the oxide layer and the base material. Therefore, it can be considered that the result of close adhesion evaluation 2 when the average thickness of the composite layer was small was inferior to that when the average thickness of the base layer was small.

In addition, as shown in Table 2, it can be seen that the average thickness of the base layer and the average thickness of the composite layer depend on the heat treatment conditions. First, samples identical in the heat treatment time but different in the heat treatment temperature are compared. Then, it can be seen that as the heat treatment temperature is higher, the average thickness of the base layer is larger and the thickness of the oxide layer is larger. However, it can be seen that when the heat treatment time is long, the thickness of the composite layer decreases as the heat treatment temperature increases. Next, samples identical in the heat treatment temperature but different in the heat treatment time are compared. Then, it can be seen that as the heat treatment time is longer, the average thickness of the base layer is larger and the thickness of the oxide layer is larger. However, it can be seen that the thickness of the composite layer decreases as the heat treatment time increases. The reason why the average thickness of the composite layer decreases as the heat treatment time and the heat treatment temperature increase can be considered as follows: the hydroxide constituting the precursor layer is easily converted into an oxide and the base layer tends to be thick. From the above, it can be seen that the heat treatment under the conditions within specific ranges easily converts the hydroxide constituting the precursor layer into an oxide and can bring about the average thickness of the base layer and the average thickness of the composite layer within the specific ranges.

The present invention is not limited to these examples, but is defined by the claims, and it is intended that the present invention includes all modifications within a meaning and a scope equivalent to those of the claims. For example, the form of the base material, the conditions of the nickel plating solution, the heat treatment conditions, and the like in the Test Examples can be appropriately changed.

REFERENCE SIGNS LIST

1 Metal material
2 Base material
3 Oxide layer
31 Base layer
32 Composite layer, 321 protrusion, 322 depression, 323 metal portion
35 Pore
4 Metal layer
100 First coating material, 200 second coating material
110 Base material, 120 thin film
130 Precursor layer
131 Base layer
132 Composite layer, 1321 protrusion, 1322 depression, 1323 metal portion
140 Metal layer
300 Nickel plating solution
L1, L2 line

The invention claimed is:

1. A metal material comprising:
a base material;
an oxide layer disposed on a surface of the base material; and
a metal layer disposed on a surface of the oxide layer, wherein
the base material includes aluminum,
the oxide layer includes aluminum, nickel, and oxygen,
the metal layer includes nickel,
an average thickness of the oxide layer is no less than 50 nm and no more than 250 nm,
the oxide layer includes a plurality of dispersed pores, and
a size of the pores is no less than 1 nm and no more than 50 nm.

2. The metal material according to claim 1, wherein
the oxide layer comprises:
a base layer disposed on a base material side and
a composite layer disposed on a metal layer side, wherein
the base layer has a higher content of aluminum than that of nickel and
the composite layer has a higher content of nickel than that of aluminum.

3. The metal material according to claim 2, wherein the base layer includes no less than 30 atomic % and no more than 60 atomic % of aluminum.

4. The metal material according to claim 2, wherein the composite layer includes no less than 30 atomic % and no more than 70 atomic % of nickel.

5. The metal material according to claim 2, wherein an average thickness of the base layer is no less than 30 nm and no more than 230 nm.

6. The metal material according to claim 2, wherein an average thickness of the composite layer is no less than 20 nm and no more than 220 nm.

7. The metal material according to claim 2, wherein
the composite layer comprises:
a plurality of protrusions protruding from the base layer; and
a metal portion interposed between adjacent protrusions thereof, wherein
each of the plurality of protrusions includes aluminum and oxygen, and
the metal portion includes nickel.

8. The metal material according to claim 1, wherein an interface at which the base material and the oxide layer are in contact with each other is formed in an uneven shape.

9. The metal material according to claim 1, wherein an average thickness of the metal layer is no less than 3 μm and no more than 15 μm.

10. The metal material according to claim 1, wherein
the base material is a wire rod, and
a diameter of the wire rod is no less than 0.04 mm and no more than 5 mm.

11. The metal material according to claim 1, wherein
the base material is a wire rod, and
a proportion of an average thickness of the oxide layer to a diameter of the base material is no less than 0.00005 and no more than 0.0025.

12. The metal material according to claim 1, wherein
the base material is a wire rod, and
a proportion of an average thickness of the metal layer to a diameter of the base material is no less than 0.003 and no more than 0.075.

13. The metal material according to claim 2, wherein
the base material is made of an aluminum alloy including a doped element, and
the base layer includes the doped element.

14. The metal material according to claim 1, wherein the oxide layer includes no less than 20 atomic % and no more than 55 atomic % of oxygen.

15. A method for manufacturing a metal material according to claim 1, comprising:
providing a base material including aluminum;
disposing a precursor layer including aluminum and nickel on a surface of the base material;
disposing a metal layer including nickel on a surface of the precursor layer; and
applying heat treatment to the base material on which the precursor layer and the metal layer are disposed, at a temperature of no less than 400° C. and no more than 600° C. to transform the precursor layer into an oxide layer including aluminum, nickel, and oxygen, wherein
the disposing a precursor layer comprises:
forming a thin film including aluminum oxide on the surface of the base material; and
applying electroless plating to the base material on which the thin film is formed, using a nickel plating solution having a pH of more than 9 and less than 11 at 25° C.

* * * * *